United States Patent [19]

Doerr

[11] 4,226,597

[45] Oct. 7, 1980

[54] USE OF 2,4,4,4-TETRACHLOROBUTYL ACETATE AS A DYE CARRIER FOR DISPERSE DYES

[75] Inventor: Richard L. Doerr, Orange, Conn.

[73] Assignee: Olin Corporation, New Haven, Conn.

[21] Appl. No.: 53,579

[22] Filed: Jun. 29, 1979

[51] Int. Cl.[3] ..... D06P 1/16

[52] U.S. Cl. ..... 8/582; 8/907

[58] Field of Search ..... 8/92

[56] References Cited

U.S. PATENT DOCUMENTS

| | | | |
|---|---|---|---|
| 2,568,859 | 9/1951 | Ladd et al. | 260/491 |
| 2,884,410 | 4/1959 | Randall | 260/192 |
| 3,728,078 | 4/1973 | Freshwater et al. | 8/94 |
| 3,756,773 | 9/1973 | Isharani | 8/175 |
| 3,787,181 | 1/1974 | Dellian et al. | 8/174 |
| 3,925,013 | 12/1975 | Axon et al. | 8/175 |
| 3,976,427 | 8/1976 | Baumann | 8/173 |
| 4,032,291 | 6/1977 | Dellian | 8/92 |

OTHER PUBLICATIONS

Textile Dyebath Additives, E. G. Hochberg and Assocs., pp. 69–97 (Jun. 1975).

American Dyestuff Reporter, (Sep. 1977), pp. 40–46, 87.

Textile Chemist and Colorist, 10, No. 2, pp. 32–39, (Feb. 1978).

J.S.D.C., pp. 417, 423 (Nov. 1977).

American Dyestuff Reporter, pp. 21–24, 48 (Aug. 1977).

*Primary Examiner*—Stanford M. Levin

*Attorney, Agent, or Firm*—William A. Simons; Thomas P. O'Day

[57] ABSTRACT

Disclosed is a method of dyeing hydrophobic textile fibers, particularly polyesters, with disperse dyes using 2,4,4,4-tetrachlorobutyl acetate as a dye carrier. Also disclosed are dye carrier compositions comprising the above chemical in combination with at least one emulsifier.

4 Claims, No Drawings

USE OF 2,4,4,4-TETRACHLOROBUTYL ACETATE AS A DYE CARRIER FOR DISPERSE DYES

BACKGROUND OF THE INVENTION

1. Field of the Invention

The present invention relates to the use of 2,4,4,4-tetrachlorobutyl acetate as a dye carrier for disperse dyeing of hydrophobic textile fibers, particularly polyesters.

2. Description of the Prior Art

The use of dye carriers in disperse dyeing of hydrophobic textile fibers is well known. Dye carriers are chemical substances added to the dye bath principally to accelerate the rate of the dyeing process. Carriers may also assist in the improvement of the color yield (depth of color) of the dyeing process, aid in level dyeing and in the penetration of the dyestuff into textile fiber.

Many chemical substances have been employed as dye carriers. For example, substances that have been, or are presently used as carriers include the following:

ortho phenylphenol
methyl benzoate
butyl benzoate
biphenyl
methyl-2 hydroxy 3-methyl benzoate
methylnapthalene
1,2,4-trichlorobenzene
para-phenylphenol
perchloroethylene
benzoic acid
methylsalicylate
diphenyl oxide
benzyl benzoate
methyl cresotinate
diallyl phthalate
diphenyl phthalate
dimethyl phthalate
m-paratoluate benzoate Nevertheless, many of the commercial carriers have one or more drawbacks including lack of availability, unpleasant odor, high toxicity, high volatility, and poor dispersion stability.

It is an object of this invention, therefore, to provide a novel dye carrier for the disperse dyeing of hydrophobic textile fibers such as polyesters.

BRIEF SUMMARY OF THE INVENTION

Accordingly, the present invention is directed to a method for the disperse dyeing of hydrophobic textile fibers using 2,4,4,4-tetrachlorobutyl acetate as a dye carrier.

Also, the present invention is directed to dye carrier compositions comprising 2,4,4,4-tetrachlorobutyl acetate and at least one emulsifier.

Further, the present invention is directed to dye carrier emulsions comprising the inventive dye carrier, at least one emulsifier and sufficient water to form a stable emulsion.

Still further, the present invention is directed to disperse dyebath compositions comprising the inventive dye carrier, at least one emulsifier, and at least one disperse dyestuff.

DETAILED DESCRIPTION 2,4,4,4-tetrachlorobutyl acetate (which has the chemical formula

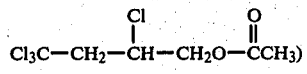

has many attributes that make it attractive as a disperse dye carrier. These include low odor, low volatility and being a highly mobile fluid that is easily formulated to provide self-emulsifying stable dispersions in water. Furthermore, this compound is advantageously a liquid at room temperature and thereby can be easily handled. Its boiling point is about 79°-80° C. at 0.8 mm Hg. Its density is 1.333 whereas water has a density of 1.0. Further, it is insoluble in water and generally soluble in most organic solvents commonly employed in the dyeing industry.

This compound may be readily prepared in high yield from low cost starting materials. For instance, it is commonly made by reacting either carbon tetrachloride or trichloromethanesulfonyl chloride with allyl acetate according to conventional reaction procedures. See U.S. Pat. No. 2,568,859, which is assigned to U.S. Rubber, for one such synthesis method. Furthermore, the instant compound may be also made by reacting 2,4,4,4-tetrachlorobutyl alcohol with acetic acid according to normal esterification techniques. However, the present invention is not limited to any particular method for making 2,4,4,4-tetrachlorobutyl acetate, but only for the use of that compound as described herein.

In usual disperse dyeing operations, dye carriers are combined with at least one emulsifier to form dye carrier compositions. Such carrier compositions may be made at the site of the manufacturing facilities of the dye carriers and shipped to the dyeworks. Alternatively, such carrier compositions may be made at the dyeworks before addition into the dyebath. In addition to emulsifiers, dye carrier compositions may, but not necessarily, also contain other substances such as solvent extenders like xylene.

Dye carrier compositions are usually formed into dye carrier emulsions by adding sufficient water to the carrier composition to form a stable emulsion thereof. In most operations, either dye carrier compositions or emulsions are then combined, either before or after the dyebath, with at least one dispersed dyestuff and sufficient water for the dyeing of hydrophobic textile materials.

Accordingly, one embodiment of the present invention is a dye carrier composition comprising the instant inventive dye carrier and at least one emulsifier.

Another embodiment is a dye carrier emulsion comprising the instant inventive carrier, at least one emulsifier and sufficient water to form a stable emulsion thereof. Preferably, water is present in an amount of about 5% to about 95% by weight of the carrier composition.

Furthermore, another embodiment of the present invention is a dyebath composition which comprises a mixture of the instant carrier, at least one emulsifier, and at least one disperse dyestuff in the presence of sufficient water to dye hydrophobic textile material.

Preferably, the emulsifiers which may be combined with 2,4,4,4-tetrachlorobutyl acetate for forming dye carrier compositions are of the anionic and nonionic types. Particular classes of emulsifiers which have been found to be suitable for this application include adducts of ethylene oxide with alkyl phenols such as nonyl phenol and dodecyl phenol. Other emulsifying agents that may be useful herein include ethoxylated castor oil, phosphated ethoxylated alcohols, amine salts of alkanyl sulfonic acid, di-2-ethylhexyl sulfo-succinate, and isopropyl amine salts of dodecyl benzene sulfonic acid. Specific emulsifier products found to be useful for this invention include nonylphenoxy polyethoxyethanol surfactants sold as the trademarked goods POLY-TERGENT ® B-300 and POLY-TERGENT ® B-350 by the Olin Corporation of Stamford, Connecticut.

Although the amount of emulsifier which may be employed may be widely varied, it is generally preferred for practicality and efficiency to employ emulsifiers in amounts from about 5% to about 50% by weight, more preferably from about 7% to about 35% by weight of the dye carrier. More specifically, the most desireable amounts of emulsifiers in commercial operations is in the range from about 10% to about 20% by weight of the carrier.

The types of dyestuffs employable in the present invention are well known in the art as disperse dyestuffs. Illustrative, although not limiting, of suitable dyestuffs are those listed in the Color Index under the CI Disperse Dye classification. The amount of dyestuff may vary widely depending upon the actual dyes used, the material to be dyed and the shade desired.

The concentration of the dye carrier in the dye bath may vary between relatively broad ranges. It is preferable that from about 1% to about 20% carrier by weight of hydrophobic textile material be employed. More preferably, the amount of carrier employed should be from about 2% to about 10% by weight of the textile material. Of course, the particular optimum concentration of dye carrier will depend in part on the type of disperse dye employed, the hydrophobic material to be dyed and the particular technique of application employed. The instant carrier of this invention is not restricted to being applied alone but can be incorporated with other dye carriers.

There are various techniques and procedures for dyeing hydrophobic textile materials which may utilize disperse dyestuffs and the dye carrier disclosed herein. Such dyeing techniques include those by beams (both atmospheric and above-atmospheric pressure), becks (both atmospheric and above-atmospheric pressure), jet (both atmospheric and above-atmospheric pressure), package, stock and other known dyeing procedures. The operating temperatures and pressures for dyeing will differ from each technique and, therefore, the present invention should not be limited to any particular operating temperatures and pressures.

The dye carrier of the present invention may be employed to dye hydrophobic textile materials, that is textile fibers made of hydrophobic polymers. Such textile fibers may be of the form of fibers, yarns, threads, fabric, ribbons, tapes, tabs and the like. Suitable examples of hydrophobic textile material include polyester and acid modified polyester, polyamide, polypropylene, polyacrylonitrile and its modified versions, modacrylics and triacetate. Preferred material is polyester. Of course, blends of different hydrophobic materials may be dyed with the present dye carrier.

While the present invention is directed to 2,4,4,4-tetrachlorobutyl acetate as a dye carrier, it should be recognized that the present invention can be easily expanded to cover other esters of 2,4,4,4-tetrachlorobutyl alcohols. The following example further illustrates the present invention. All parts and percentages are by weight unless otherwise indicated.

EXAMPLE

A dye carrier emulsion was formed from a dye carrier composition consisting of 10 grams of 2,4,4,4-tetrachlorobutyl acetate and 10 grams of POLY-TERGENT ® B-300 surfactant (a nonylphenoxy polyethoxyethanol emulsifier made by Olin Corporation of Stamford, Connecticut)[1] by adding 80 grams of distilled water to the carrier composition with vigorous agitation to produce a suitable oil in water emulsion of the carrier.

[1]POLY-TERGENT ® is a trademark of the Olin Corporation

Various disperse dye compositions were formed by mixing 10 grams of various dyestuffs with 5 grams of a dispersing agent, sodium naphthalene sulfonic acid formaldehyde and 85 grams of distilled water. These mixtures were then ball milled for 3 hours to provide an uniform 10% dispersion of dispersed dyes in water. The various dyestuffs employed are listed in Table I.

An amount of the above dye carrier emulsion was mixed with an amount of each dye dispersion and additional distilled water to form several dyebath compositions. These dyebath compositions were acidified with acetic acid to adjust the pH to about 4–5. A 10 gram sample of polyester (heat set 100% Dacron-type 64) was then placed in the dyebath. The amount of carrier in each dyebath (except for control experiments) was 5% based on the dry weight of the polyester fabric. The amount of each dyestuff was 2% of the dry weight of the polyester fabric. The ratio of dyebath liquor to dry fabric was 50:1 by weight.

The dyebath was heated from 25° C. to 95° C. in 30 minutes and maintained at 95° C. for 60 more minutes. The dyed fabric was rinsed in warm water, air dried and ironed smooth prior to measuring the depth of dye shape with a Hunter reflectometer. The results of this experiment are shown in Table I, below.

TABLE I

| | Reflectance Of Dyed Fabric | | |
|---|---|---|---|
| Disperse Dye | No Carrier (Control) | 2% 2,4,4,4-tetrachlorobutyl Acetate Carrier | Δ* |
| Orange #129 | 53.6 | 48.4 | 5.2 |
| Yellow #42 | 84.2 | 80.5 | 3.7 |
| Blue #3 | 30.4 | 26.3 | 4.1 |
| Violet #27 | 43.7 | 30.1 | 13.6 |
| Red #60 | 48.6 | 43.2 | 5.4 |
| Orange #5 | 32.4 | 30.4 | 2.0 |
| Red #1 | 35.2 | 29.7 | 5.5 |
| Black #1 | 26.9 | 22.4 | 4.5 |

*Δ = Reflectance of control fabric - Reflectance of carrier dyed fabric

The lower reflectance values of the fabric dyed with 5% 2,4,4,4-tetrachlorobutyl acetate clearly demonstrates a deeper shade of color and more efficient utilization of the disperse dye for dyeing the polyester compared to the control using no carrier.

What is claimed is:

1. A dye carrier composition comprising a dye carrier and at least one emulsifier, said dye carrier comprising 2,4,4,4-tetrachlorobutyl acetate and said emulsifier being from about 5% to about 50% by weight of said dye carrier.

2. The composition of claim 1 wherein said emulsifier is nonylphenoxy polyethoxyethanol.

3. A dye carrier emulsion comprising a dye carrier, at least one emulsifier and sufficient water to form a stable emulsion, said dye carrier comprising 2,4,4,4-tetrachlorobutyl acetate.

4. In a dyebath composition comprising at least one disperse dyestuff, at least one emulsifier and dye carrier, the improvement wherein said dye carrier comprises 2,4,4,4-tetrachlorobutyl acetate.

* * * * *